US012800247B2

(12) United States Patent
Merklin et al.

(10) Patent No.: US 12,800,247 B2
(45) Date of Patent: Nov. 17, 2026

(54) MODULAR THUMB REST MOUNTING SYSTEM FOR A FIREARM

(71) Applicant: Icarus Precision LLC, Washougal, WA (US)

(72) Inventors: Travis Merklin, Washougal, WA (US); Michael Parks, Eagle, ID (US)

( * ) Notice: Subject to any disclaimer, the term of this patent is extended or adjusted under 35 U.S.C. 154(b) by 0 days.

(21) Appl. No.: 19/241,140

(22) Filed: Jun. 17, 2025

(65) Prior Publication Data

US 2025/0383168 A1 Dec. 18, 2025

Related U.S. Application Data

(60) Provisional application No. 63/660,966, filed on Jun. 17, 2024.

(51) Int. Cl.
*F41C 23/10* (2006.01)
*F41A 3/66* (2006.01)

(52) U.S. Cl.
CPC ..... *F41A 3/66* (2013.01); *F41C 23/10* (2013.01)

(58) Field of Classification Search
None
See application file for complete search history.

(56) References Cited

U.S. PATENT DOCUMENTS 1,962,775 A * 6/1934 Jones ..... F41C 23/10 42/71.02
RE20,456 E * 7/1937 McClarin, Sr. ..... F41C 23/10 42/71.02
D142,016 S * 8/1945 Birk ..... D22/104
2,654,174 A * 10/1953 Hansen ..... F41A 17/20 42/71.02
2,899,767 A * 8/1959 Boudreau ..... F41C 27/22 42/106
2,903,810 A * 9/1959 Lewis ..... F41C 23/10 42/59
5,212,327 A * 5/1993 Schuemann ..... F41A 35/06 42/70.01
6,234,059 B1 * 5/2001 Fuchs ..... F41A 19/15 89/196
7,313,996 B2 * 1/2008 Werner ..... F41A 35/06 89/181
9,194,649 B2 * 11/2015 Nierenberg ..... F41C 23/08
9,696,111 B2 * 7/2017 Saadon ..... F41C 23/12
10,612,880 B1 * 4/2020 Ding ..... F41C 23/14
10,670,359 B2 * 6/2020 Indruch ..... F41A 17/36
11,604,041 B1 * 3/2023 Alexander ..... F41A 17/72
12,085,357 B2 * 9/2024 Alson ..... F41C 23/06
12,117,262 B2 * 10/2024 Coonan ..... F41C 23/04
(Continued)

OTHER PUBLICATIONS

Field Manual No. 3-23.35, Combat Training with Pistols, M9 and M11, Headquarters Department of the Army, Washington, DC, Jun. 2003, 71 pages.

*Primary Examiner* — Derrick R Morgan
(74) *Attorney, Agent, or Firm* — Miller Nash LLP

(57) ABSTRACT

A modular thumb rest for coupling to a firearm. The modular thumb rest includes a thumb-pad surface, a mounting body, and a tongue. The mounting body extends away from a rear surface of the modular thumb rest in a first direction. The rear surface is opposite the thumb-pad surface. The tongue extends away from the mounting body in a second direction that is substantially perpendicular to the first direction.

12 Claims, 7 Drawing Sheets

(56) References Cited

U.S. PATENT DOCUMENTS

| | | | | | |
|---|---|---|---|---|---|
| D1,066,549 | S | * | 3/2025 | Smathers | D22/108 |
| D1,104,195 | S | * | 12/2025 | Felix, III | D22/108 |
| 2002/0170224 | A1 | | 11/2002 | Lawless | |
| 2023/0013901 | A1 | * | 1/2023 | Strayer | F41C 23/06 |
| 2023/0051299 | A1 | * | 2/2023 | Howard | F41C 23/06 |
| 2024/0159494 | A1 | * | 5/2024 | Salinas | F41C 23/10 |
| 2025/0003715 | A1 | * | 1/2025 | Star | F41C 23/06 |
| 2025/0189247 | A1 | * | 6/2025 | Merklin | F41A 3/66 |
| 2026/0009611 | A1 | * | 1/2026 | Middleton | F41A 17/46 |
| 2026/0009619 | A1 | * | 1/2026 | Smathers | F41A 19/38 |

* cited by examiner

MODULAR THUMB REST MOUNTING SYSTEM FOR A FIREARM

CROSS-REFERENCES TO RELATED APPLICATIONS

This patent application claims the benefit of provisional Application No. 63/660,966 filed Jun. 17, 2024, which is incorporated into the present disclosure by this reference.

TECHNICAL FIELD

The subject matter is related to an apparatus and methods for a modular thumb rest mounting system for a firearm.

BACKGROUND

Modular handgun systems—i.e., handguns comprised of multiple, modular components—have been successful inside and outside the military context because of the benefits of a modular handgun. Traditional, non-modular handguns were limited to particular uses and applications based on the configuration of the weapon. As a result, a shooter needed to have access to multiple, complete handguns for multiple applications, an expensive and burdensome endeavor.

However, by employing a modular handgun system, a person can quickly and safely alter a handgun to make it better suited or more effective for the particular application at hand. The handgun could be modified for the needs of the shooter, such as changing the gun to suit a particular user's specific requirements. For instance, a shooter with smaller hands may need a frame with a smaller grip than a shooter with larger hands. Alternatively or additionally, the handgun can be modified for the particular mission, such as adding particular accessories needed for a night mission. Modular handgun systems have also become popular for their ease of use and maintenance, as repairing or replacing parts on a modular handgun is much simpler than doing so on a traditional, non-modular weapon, a great benefit in combat settings particularly. And, of course, modular handgun systems have grown in popularity for the customizability they provide, for instance, the ability to swap out a frame with a traditional black grip for a frame with a more unique grip, making the handgun more aesthetically pleasing to a particular shooter.

The main components of a modern, magazine-fed handgun are the frame, which may include an integrated grip or be used with a modular grip that is held during shooting; an integrated or modular trigger assembly for firing the weapon; an integrated or modular trigger guard within which the trigger of the trigger assembly is positioned; and an upper slide portion, which includes the barrel and firing mechanism. Modular handguns are composed of multiple components which can be changed out as the user sees fit. They may also have the ability to add accessories to the handgun. For instance, some modular handguns include a picatinny rail along the underside of the portion of the frame that extends away from the trigger guard and receives the barrel of the slide, to which various accessories may be mounted.

Various shooting grips are known. For instance, a shooter may hold the handgun with only his dominant hand, otherwise referred to as his firing hand; the shooter's dominant hand is the only means for steadying the weapon, and the shooter's dominant hand and arm absorb the recoil when the weapon is fired. This may lead to decreased accuracy on successive shots, as the shooter must reposition the weapon after each shot to account for the vertical displacement from the recoil, thereby decreasing speed and accuracy.

Alternatively, a shooter may use a two-hand grip, whereby his dominant hand is still utilized for firing the weapon, but his non-dominant, non-firing hand is also used to steady the weapon, thereby improving support for the weapon and directing some of the recoil to the non-firing hand and arm and away from the firing hand and arm, decreasing the overall recoil effect. By decreasing the overall recoil effect, less repositioning is needed between shots, and speed and accuracy are thereby increased.

One popular two-hand grip, part of the "Weaver" stance, was introduced by Los Angeles County Deputy Sheriff Jack Weaver in the 1950s. An Army training manual from June 2003, *Combat Training with Pistols, M9 and M11*, explains that two-hand shooting grips, including the "Weaver" grip, "allow [ ] the firer to steady the firing hand and provide maximum support during firing. The nonfiring hand becomes a support mechanism for the firing hand by wrapping the fingers of the nonfiring hand around the firing hand. Two-hand grips are recommended for all pistol firing." Two-hand grips are also popular in competition shooting, where speed and accuracy are crucial to success.

Handgun frames may include a thumb rest, which is, generally speaking, a lateral extension from a side of the handgun frame which permits the user to rest his thumb during shooting. For instance, U.S. Des. Pat. No. 142,016 to Birk, issued Aug. 14, 1945, discloses a laterally extending, concave thumb rest positioned on the lefthand side of the frame, rearward of the trigger and frontward of the grip, the thumb rest screwed onto the side of the frame. U.S. Pat. Appl. Pub. No. US 2002/0170224 A1 to Lawless, published Nov. 21, 2002, discloses inclusion of grip enhancers on a firearm, including as a thumb rest to improve firing accuracy, including countering recoil. And U.S. Pat. No. 2,899,767 to Boudreau, issued Aug. 18, 1959, teaches inclusion of a thumb rest on a firearm specifically to counter recoil.

Some thumb rests (such as the thumb rest disclosed in U.S. Des. Pat. No. 142,016) are positioned for the thumb of the shooting hand, and thus may be located along the side of the frame at a position substantially rearward of the trigger. Other thumb rests are positioned for the thumb of the non-shooting hand, for use in a two-hand grip, and thus may be located along the side of the frame at a position substantially forward of the trigger. The thumb rest may be positioned along the lefthand side of the frame (as the frame is pointed away from the shooter) so that it may be employed by a righthanded shooter using a two-hand grip; or it may be positioned along the righthand side of the frame (as the frame is pointed away from the shooter) so that it may be employed by a lefthanded shooter using a two-hand grip. Some frames may include a thumb rest located along each side of the frame so that the frame is ambidextrous.

The thumb rest may serve multiple purposes. The thumb rest aids the shooter in placing his thumb correctly on the handgun to facilitate a stable and optimal grip. By guiding the shooter's thumb to a proper alignment on the weapon, the shooter's thumb does not end up being positioned such that it may be injured during shooting; for instance, in a two-hand grip the recoil during shooting could cause injury to the shooters' nonfiring thumb if his nonfiring thumb is positioned in the rear of the weapon during shooting rather than alongside the weapon. The thumb rest may also provide downward pressure from the nonfiring hand thumb, resisting recoil forces when the weapon is fired, thereby improving shooting accuracy. Thus, thumb rests are desirable to shooters using a two-hand grip, including tactical and competition shooters.

Integral thumb rests (that is, thumb rests formed as part of the frame) are known, as are modular thumb rests (that is, thumb rests that are a separate piece from the frame). For instance, U.S. Pat. No. 9,194,649 to Nierenberg, issued Nov. 24, 2015, discloses a lateral grip pad extending laterally away from the grip mount of the handgun to provide a thumb contact point for a non-trigger hand, which may either be monolithic with the frame of the handgun, or may be a separately attached piece. As a separately attached piece, the thumb rest disclosed in the '649 patent may be attached via an accessory rail on the frame, particularly, a picatinny rail, and then securely fixed to the frame via multiple connection points such as screws or bolts; or it may be securely fixed directly to the frame via multiple connection points such as screws or bolts. Pre-dating the '649 patent's filing date by more than two years, a "Gas Pedal" thumb rest was available in the marketplace, sold as a separate accessory which could be securely attached to the frame via multiple screws or bolts. In both of these thumb rests, a large and bulky mounting plate is necessary to provide enough connection points between the thumb rest and the handgun frame for there to be secure attachment of the thumb rest to the frame; without the multiple connection points, the recoil forces imparted onto the thumb rest when the weapon is fired could cause the thumb rest to snap off the frame, reducing firing accuracy and potentially injuring the shooter. As a result, the thumb rest disclosed in the '649 patent and commercially exploited as the "Gas Pedal," while modular, proves to be bulky and cumbersome to use, sticking out past the frame, taking time to mount, and in generally proving to be not aesthetically pleasing. The other prior art thumb rests suffer from similar issues. Embodiments of the invention address these and other limitations.

Configurations of the disclosed technology address shortcomings in the prior art.

DETAILED DESCRIPTION

As described in this document, aspects are directed to a modular thumb rest mounting system for a firearm, where the thumb rest is removably installed on the frame of the firearm. In configurations, the thumb rest can be removably installed on either side of the frame of the firearm to allow for left- or right-handed use. In configurations, the thumb rest can be removably installed to the frame without the use of tools. As a result, configurations of a firearm having the disclosed features can be more easily and quickly adapted for use, an advantage in tactical and competition shooting scenarios.

As an initial matter, this description makes use of terms such as "proximal," "distal," "rear" or "rearward," "front" or "forward," "upper," "lower," "vertical," "horizontal," "right," and "left." These are used for convenience and in reference to the views provided in drawings. In particular, a handgun is typically held by the user so that the barrel is substantially parallel to the surface upon which the user is standing or lying and extending away from the user. As used in this disclosure, "substantially parallel" means largely or essentially equidistant at all points, without requiring perfect parallelism. Also, the grip of the handgun is typically vertical, being perpendicular to both the barrel and the surface upon which the user is standing or lying. "Horizontal" means substantially parallel to the surface upon which the user is standing or lying, while "vertical" means substantially perpendicular to the horizontal direction. As used in this disclosure, "substantially perpendicular" means largely or essentially at right angles, without requiring perfect perpendicularity. Thus, the proximal end, or rear end or rearward end, of the handgun is the end closest to the user's head and face in a typical shooting posture, while the distal end, or front end or forward end, of the handgun is the end farthest from the user's head and face in a typical shooting posture. In addition, "upper" and "lower" mean vertically farther and closer, respectively, to the surface upon which the user is standing or lying when the user is in a typical shooting posture. Likewise, "left" and "right" refer to the user's left and right sides when the user is in a typical shooting posture. Even so, the modular firearm and its components may have a number of orientations in actual use. Thus, a feature that is proximal, distal, rearward, forward, upper, lower, vertical, horizontal, to the right, or to the left in the figures may not have that same orientation or direction in actual use.

Figure 1:
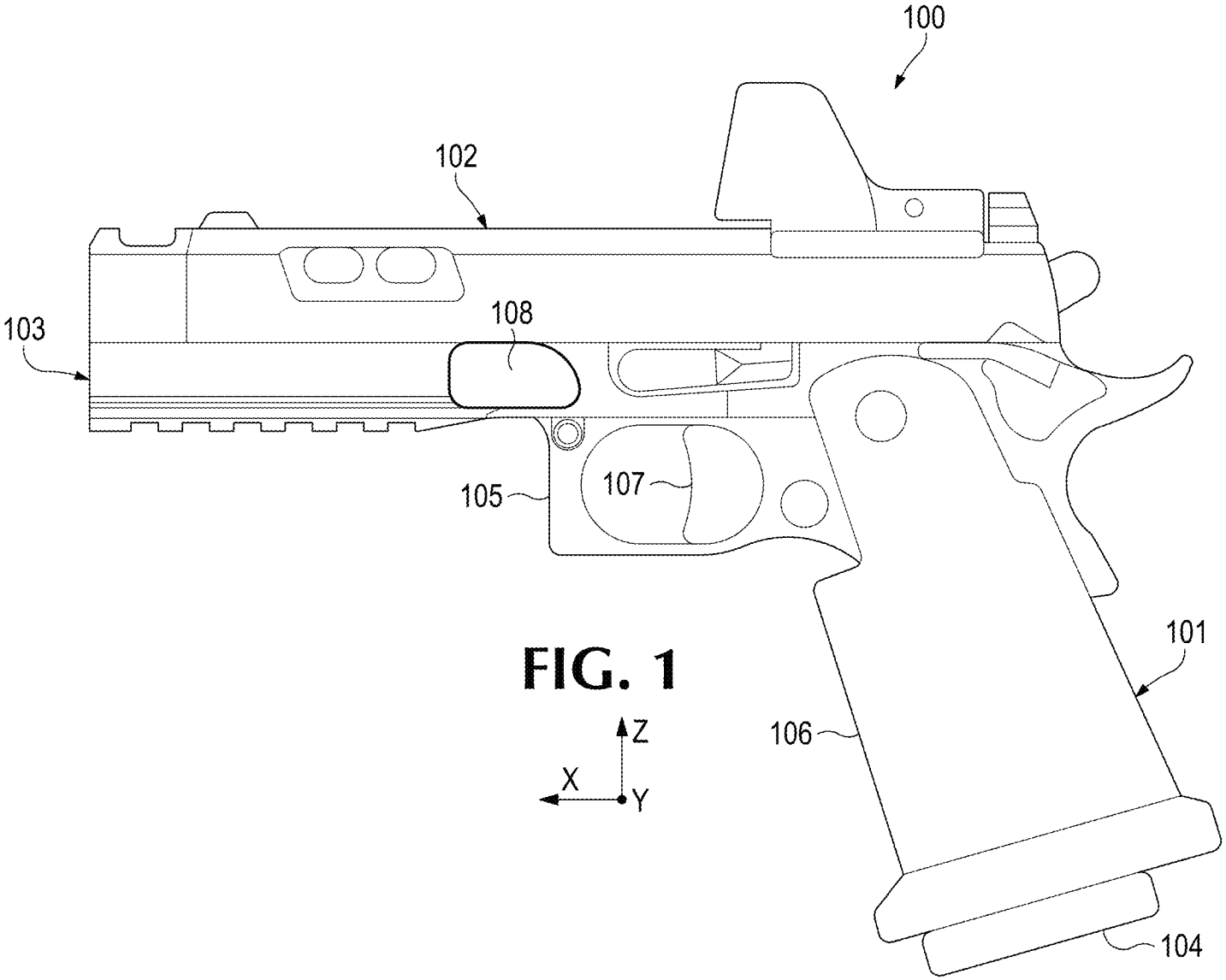
FIG. 1 is a side view of a modular firearm, according to an example configuration.
Figure 2:
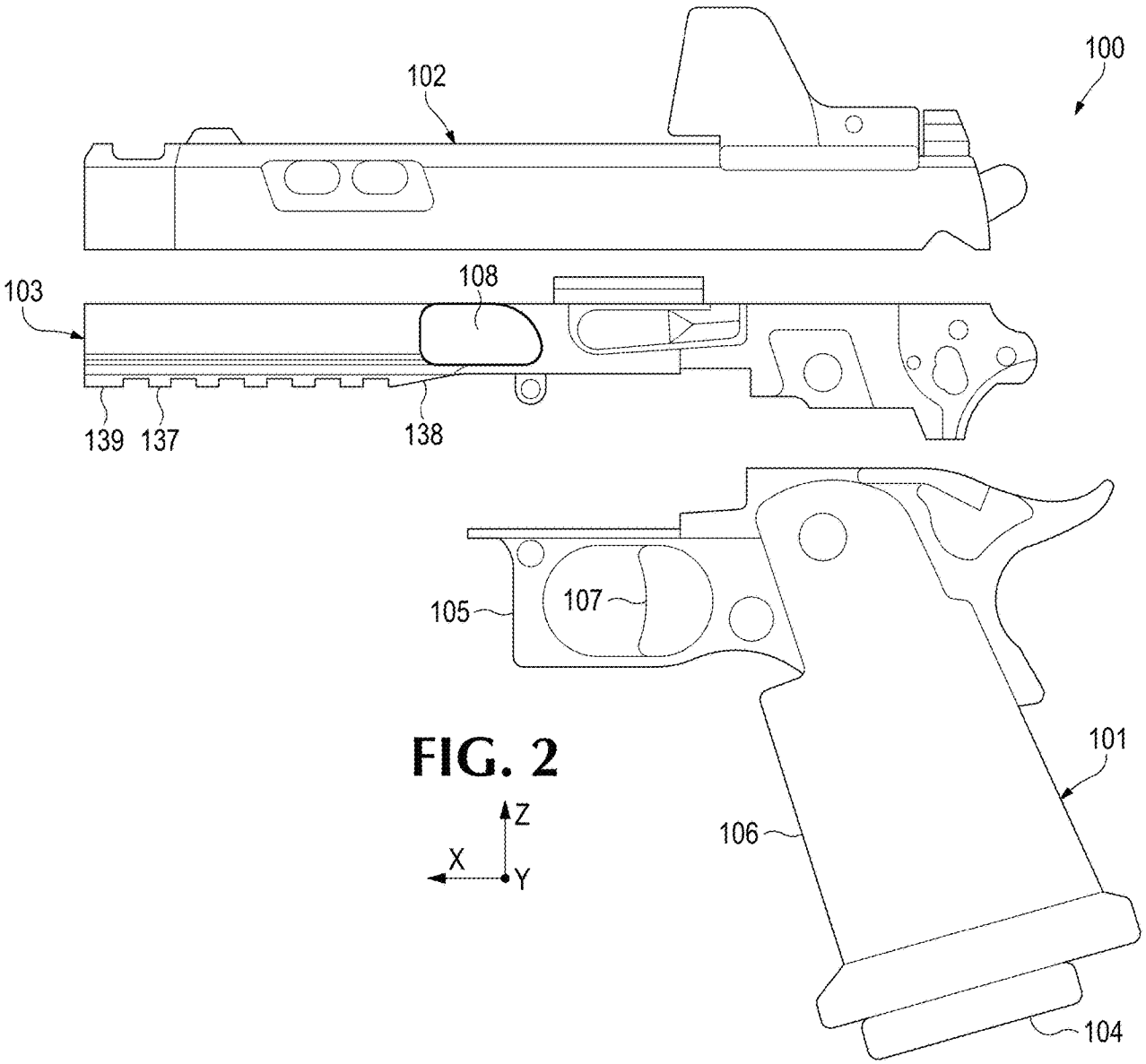
FIG. 2 is a partially exploded view of the example modular firearm of FIG. 1.

FIG. 1 is a side view showing portions of a modular firearm 100 according to an example configuration. FIG. 2 is a partially exploded view of the example modular firearm 100 of FIG. 1. While other configurations are contemplated and suitable for the disclosed technology, the drawings illustrate an example of a modular 2011-style handgun. As illustrated in FIGS. 1-2, a modular handgun may include a grip module 101, a slide assembly 102, a frame 103, and a magazine 104. In the illustrated configuration, the grip module 101 includes a trigger guard 105, a hand grip 106, and a trigger 107. The slide assembly 102 includes the handgun's barrel and firing mechanisms and typically fits between the side walls of the frame 103. The magazine 104 typically fits within the hand grip 106.

FIGS. 1-2 also illustrates example x-, y-, and z-axes for illustrative purposes, though the y-axis itself is not shown in FIG. 1 because it is perpendicular to the page. The x-axis and the y-axis correspond to the horizontal plane as explained above, while the z-axis corresponds to the vertical direction as described above.

Figure 3:
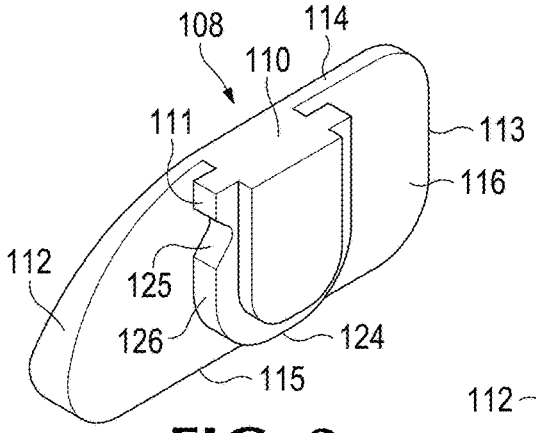
FIG. 3 is an isometric view of an example modular thumb rest according to an example configuration.
Figure 4:
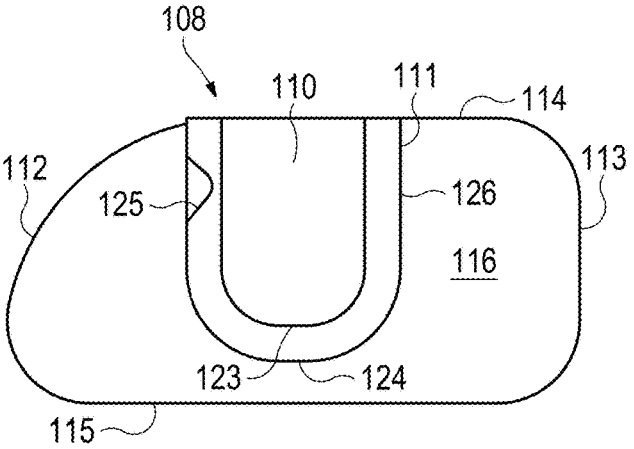
FIG. 4 is a rear view of the example modular thumb rest of FIG. 3.
Figure 5:
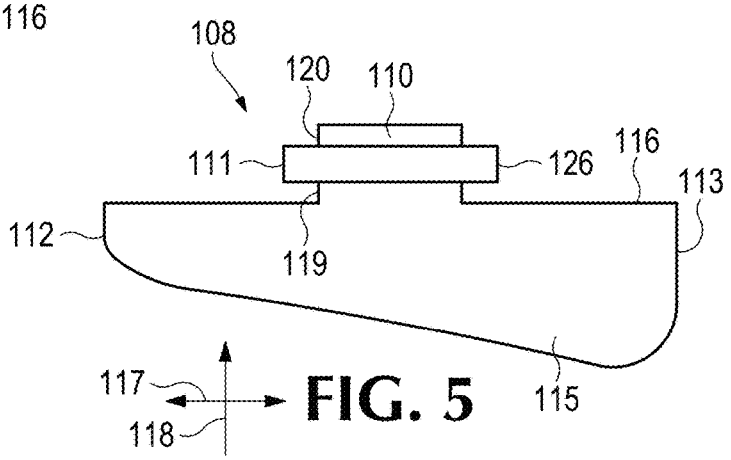
FIG. 5 is a top view of the example modular thumb rest of FIG. 3.
Figure 6:
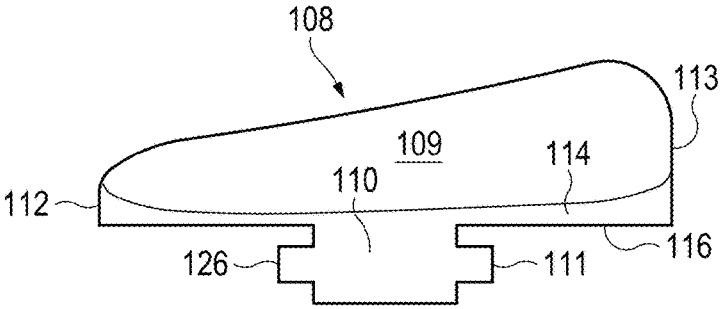
FIG. 6 is a bottom view of the example modular thumb rest of FIG. 3.
Figure 8:
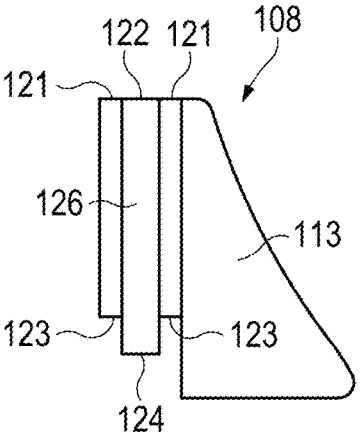
FIG. 8 is a left-side view of the example modular thumb rest of FIG. 3.
Figure 7:
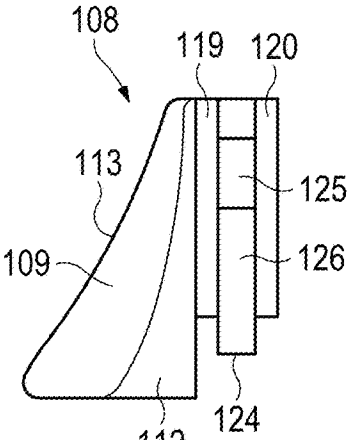
FIG. 7 is a right-side view of the example modular thumb rest of FIG. 3.

FIG. 3 is an isometric view showing portions of a modular thumb rest 108 according to an example configuration. FIG. 4 is a rear view of the example modular thumb rest 108 of FIG. 3. FIG. 5 is a top view of the example modular thumb rest 108 of FIG. 3. FIG. 6 is a bottom view of the example modular thumb rest 108 of FIG. 3. FIG. 7 is a right-side view of the example modular thumb rest 108 of FIG. 3. FIG. 8 is a left-side view of the example modular thumb rest 108 of FIG. 3. As illustrated in FIGS. 3-8, a modular thumb rest 108 may include a thumb-pad surface 109, a mounting body 110, and a tongue 111. The modular thumb rest 108 may be part of a modular firearm 100, such as the modular firearm of FIGS. 1-2.

The thumb-pad surface 109 is configured to provide a resting surface for the pad of a thumb of the user. In configurations, the thumb-pad surface 109 is smooth, while in other configurations, the thumb-pad surface 109 is textured or otherwise roughened to provide a grippier surface for the user's thumb to rest upon. As illustrated in FIGS. 3-8, in configurations, the thumb-pad surface 109 curves from a thinnest portion at a rear edge 112 of the modular thumb rest 108 to a thickest portion at a front edge 113 of the modular thumb rest 108 that is opposite the rear edge 112 of the modular thumb rest 108. In configurations, the front edge 113 of the modular thumb rest 108 curves from a thinnest portion at an upper edge 114 of the modular thumb rest 108 to a thickest portion at a lower edge 115 of the modular thumb rest 108 that is opposite the upper edge 114 of the modular thumb rest 108. Accordingly, in configurations such as the one illustrated in FIGS. 3-8, the thickest part of the modular thumb rest 108 is at the lower part of the front edge 113 of the modular thumb rest 108. In other configurations, different shapes for the thumb-pad surface 109 may be provided.

The mounting body 110 extends away from a inner surface 116 of the modular thumb rest 108 in a first direction 117. The inner surface 116 is on the opposite side of the modular thumb rest 108 from the thumb-pad surface 109. The first direction 117 is away from both the inner surface 116 of the modular thumb rest 108 and the thumb-pad surface 109. As illustrated in FIGS. 5 and 6, the first direction 117 is substantially perpendicular to the inner surface 116. The tongue 111 extends away from the mounting body 110 in a second direction 118. The second direction 118 is substantially perpendicular to the first direction 117.

In the illustrated configuration, the mounting body 110 includes a first surface 119 that is substantially parallel to the first direction 117, and a second surface 120 that is substantially parallel to the first direction 117. In the illustrated configuration, the tongue 111 extends away from the mounting body 110 between the first surface 119 and the second surface 120 and is substantially perpendicular to each of the first surface 119 and the second surface 120. In configurations, the first surface 119 and the second surface 120 may be collinear, such as is illustrated in FIG. 5.

In configurations, each of the mounting body 110 and the tongue 111 has a top edge and a bottom edge opposite the top edge, where the bottom edge 123 of the mounting body 110 and the bottom edge 124 of the tongue 111 are each substantially U-shaped. In the illustrated configuration, neither the top edge 121 nor the bottom edge 123 of the mounting body 110 coincide with either of the rear edge 112 or the front edge 113 of the modular thumb rest 108. In configurations, the tongue 111 includes a notch 125 in a side edge 126 of the tongue 111, the side edge 126 being between the top edge 122 of the tongue 111 and the bottom edge 124 of the tongue 111. In such configurations, a set pin or similar feature may interact with the notch 125 to help retain the modular thumb rest 108 within the modular frame 103. For example, such a set pin may be inserted into the hole 127 illustrated in FIGS. 11-16.

In configurations, the modular thumb rest 108 is formed as a single piece, for example, the modular thumb rest 108 may be CNC (computer numerical control) machined as a single piece. In another embodiment, the modular thumb rest 108 is formed as two or more pieces that are connected, for example, as a thumb-pad surface 109 separate from a mounting body 110, which are then connected to form the modular thumb rest 108.

Figure 9:
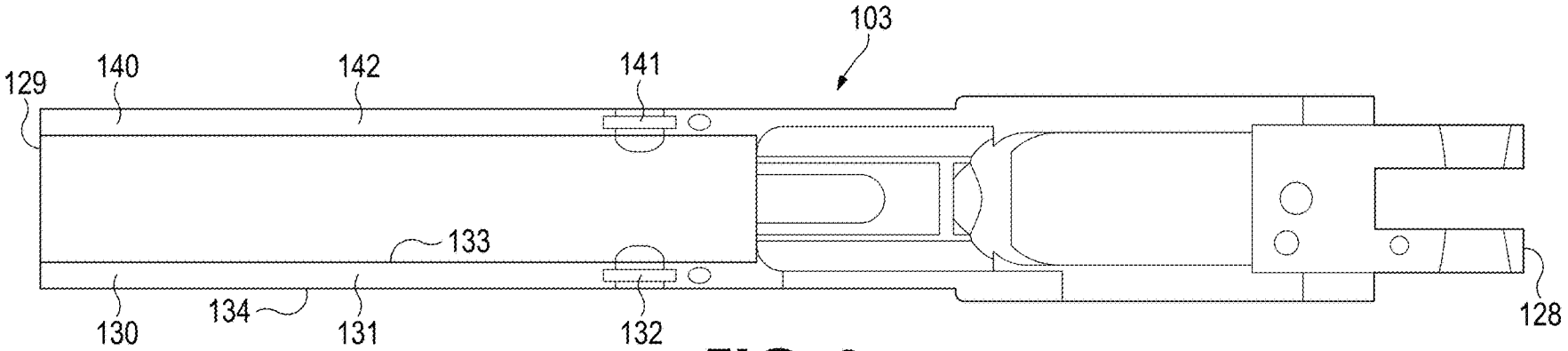
FIG. 9 is a top view of an example frame shown in isolation.

FIG. 9 is a top view showing portions of a modular frame 103 according to an example configuration. The modular frame 103 may be part of a modular firearm, such as the modular firearm 100 of FIGS. 1-2. As illustrated in FIG. 9, a modular frame 103 has a proximal end 128 of the modular frame 103 that is opposite a distal end 129 of the modular frame 103.

The modular frame 103 includes a longitudinal first sidewall 130. In use, the first sidewall 130 is typically horizontal. The first sidewall 130 could be on the right side or the left side of the modular frame 103. The first sidewall 130 has an upper edge 131 that has a substantially vertical slot 132, or recess, through the upper edge 131. When used in this disclosure to describe a feature of the modular firearm 100 or its components, "substantially vertical" means largely or essentially perpendicular to both the firearm's barrel and the surface upon which the user is standing or lying when the user is in a typical shooting posture, without requiring perfect verticality. The vertical slot 132 of the first sidewall 130 is configured to accept a modular thumb rest, such as the modular thumb rest 108 discussed above for FIGS. 3-8. In alternative configurations, the slot through the first sidewall 130 is not substantially vertical.

In configurations, the vertical slot 132 is forward of the trigger 107 (see FIGS. 1-2) so that the modular thumb rest 108, when positioned within the vertical slot 132, is located in an appropriate position to accept the user's thumb. Typically, it is the thumb of the user's non-firing hand (i.e. the hand that is not contacting the trigger 107) that would contact and rest on the modular thumb rest 108. Even so, some users prefer to rest the thumb of the firing hand on the modular thumb rest 108. Accordingly, the vertical slot 132 may be formed at a position along the first sidewall 130 that is forward of the trigger 107 but rearward of the forward-most portion of the trigger guard 105 when the handgun is fully assembled. Alternatively, the vertical slot 132 may be formed at a position along the first sidewall 130 that is forward of the trigger 107 and in-line with the forward-most portion of the trigger guard 105 when the handgun is fully assembled. In configurations, the vertical slot 132 is instead formed at a position along the first sidewall 130 that is forward of the trigger 107 and forward of the forward-most portion of the trigger guard 105 when the handgun is fully assembled.

Figure 12:
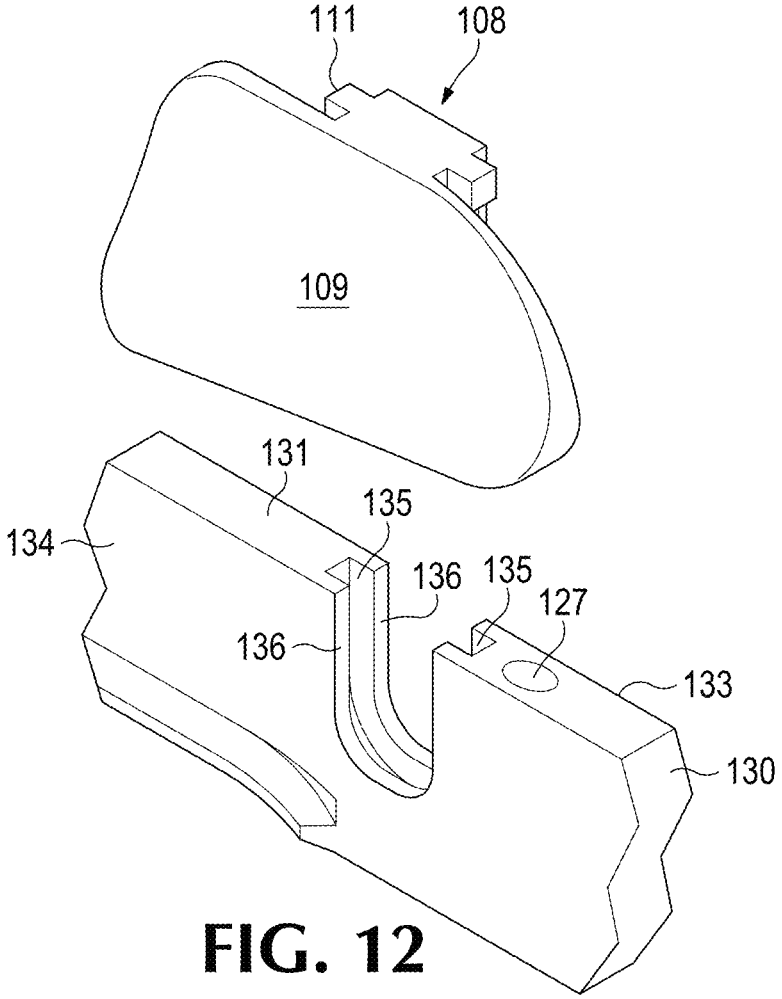
FIG. 12 is an exploded version of the detailed view of FIG. 11.
Figure 13:
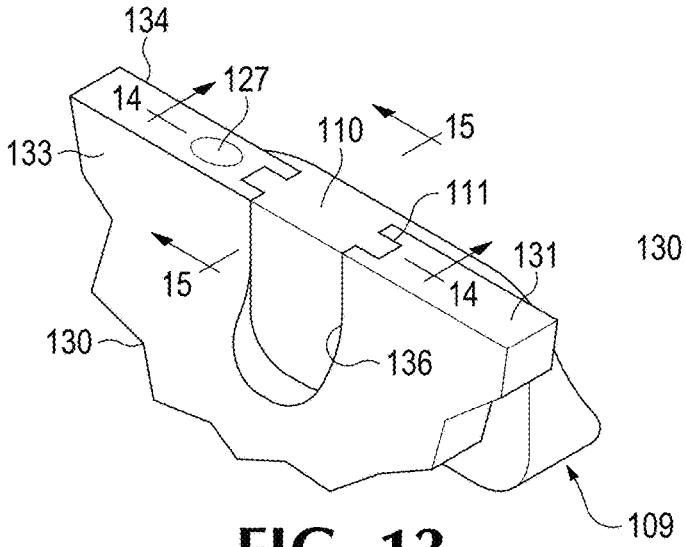
FIG. 13 is an opposite-side, isometric view of the detailed view of FIG. 11.
Figure 14:
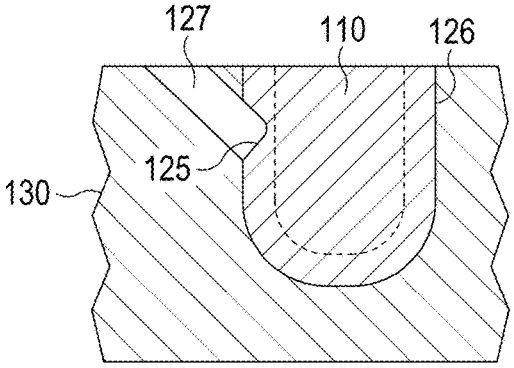
FIG. 14 is a sectional view as defined in FIG. 13
Figure 15:
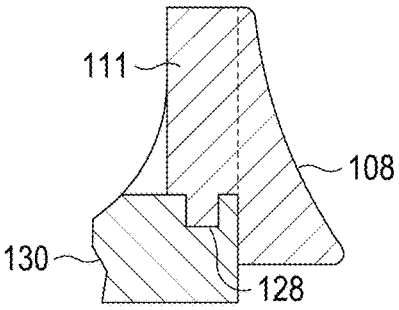
FIG. 15 is a sectional view as defined in FIG. 13
Figure 16:
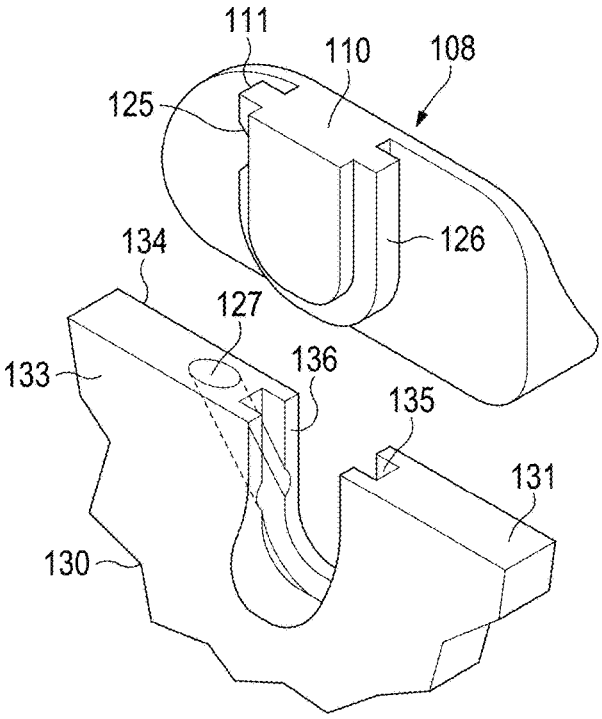
FIG. 16 is an exploded version of the detailed view of FIG. 13.

In some configurations, the first sidewall 130 has an inner surface 133 and an outer surface 134, and the vertical slot 132 includes a substantially vertical groove 135 that is between the inner surface 133 and the outer surface 134 of the first sidewall 130. (An example of this is illustrated in FIG. 12.) In such configurations, the inner surface 133 and the outer surface 134 may each include a channel 136. As illustrated, each of the vertical groove 135 of the vertical slot 132 and each channel 136 is substantially U-shaped to accommodate the mounting body 110 and the tongue 111 of the modular thumb rest 108.

In some configurations, the modular frame 103 includes a picatinny rail 137 at the distal end 129 of the modular frame 103. In such configurations, the vertical slot 132 of the first sidewall 130 is separate from the picatinny rail 137 and is farther from the distal end 129 of the modular frame 103 than the picatinny rail 137 is from the distal end 129 of the modular frame 103. By "separate from," it is meant that the picatinny rail 137 and vertical slot 132 are distinct features, and the vertical slot 132 is not part of the picatinny rail 137. Stated another way, the picatinny rail 137 has a proximal end 138 and an opposite, distal end 139. The distal end 139 of the picatinny rail 137 is at the distal end 129 of the modular frame 103, and the vertical slot 132 is longitudinally between the proximal end 138 of the picatinny rail 137 and a proximal end 128 of the modular frame 103.

In the illustrated configuration, the modular frame 103 includes a longitudinal second sidewall 140. The first sidewall 130 and the second sidewall 140 are substantially parallel. The space between the first sidewall 130 and the second sidewall 140 typically accommodates the slide assembly 102 of the firearm. The second sidewall 140 has a substantially vertical slot 141 through an upper edge 142 of the second sidewall 140. The vertical slot 141 of the second sidewall 140 is configured to accept another modular thumb rest, such as the modular thumb rest 108 discussed above for FIGS. 3-8. In configurations, this other modular thumb rest 108 may be configured for handedness. So, the modular thumb rest 108 configured for the vertical slot 141 on the second sidewall 140 might not be identical to what would be accepted by the vertical slot 132 on the first sidewall 130 given the different shapes needed to accommodate the thumb of the user's right hand on one side of the firearm the thumb of the user's left hand on the other side of the firearm.

The features described in this disclosure for the first sidewall 130 apply equally to the second sidewall 140 and, for brevity, are not repeated here.

Accordingly, configurations may include a recess, such as a vertical slot 132, 141, on either or both of the first sidewall 130 and the second sidewall 140. As a result, the modular frame 103 may be setup for use by a righthanded user or a lefthanded user. For configurations having a recess on each sidewall, the recesses may be substantially aligned. As used in this context, "substantially aligned" means largely or essentially equidistant from the distal end 129 of the modular frame 103, without requiring perfect alignment. Configurations having a recess on each sidewall are more adaptable and provide more flexibility of use than configurations that only include one recess on either side of the modular frame 103.

Figure 10:
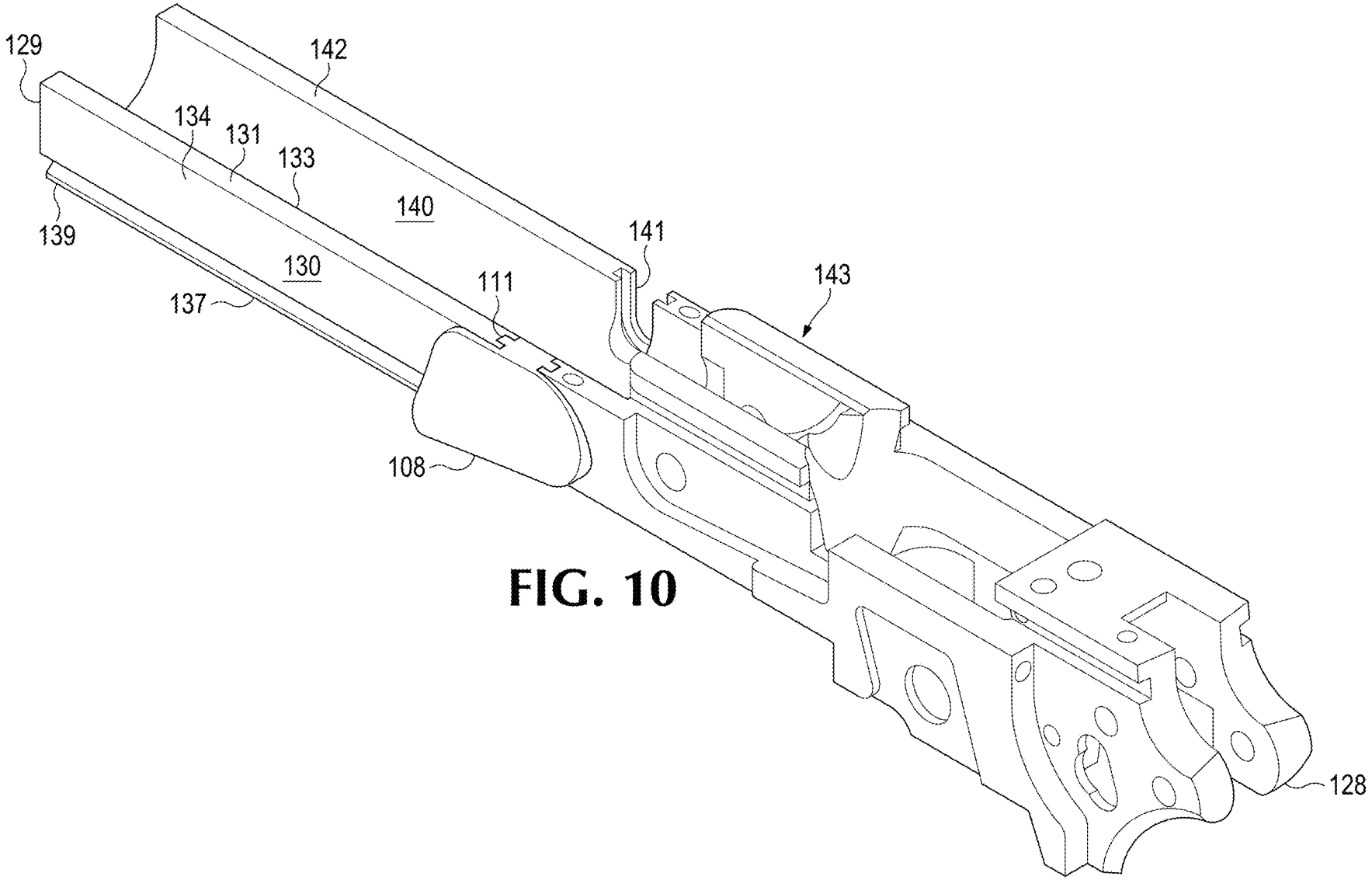
FIG. 10 is an isometric view of an example frame assembly, shown in isolation.
Figure 11:
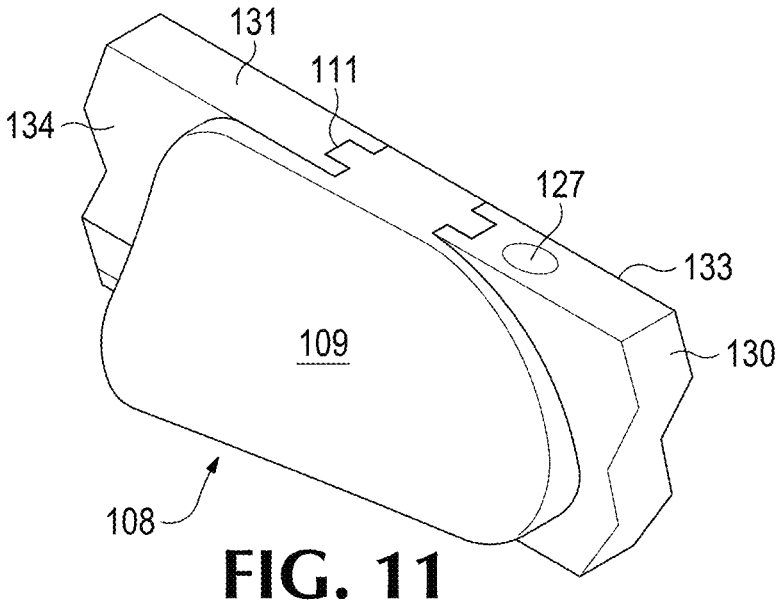
FIG. 11 is a detailed view a portion of the frame assembly of FIG. 10.

FIG. 10 is an isometric view showing portions of a frame assembly 143 according to an example configuration. The frame assembly 143 may be part of a modular firearm, such as the modular firearm 100 of FIGS. 1-2. FIGS. 11-16 provide additional views as described above under the Brief Description of the Drawings section. As illustrated in FIGS. 10-16, a frame assembly 143 includes a modular frame 103 and a modular thumb rest 108. The modular frame 103 of FIGS. 10-16 is as described above for the modular frame 103 of FIG. 9. Likewise, the modular thumb rest 108 of FIGS. 10-16 is as described above for the modular thumb rest 108 of FIGS. 3-8. As illustrated in FIGS. 10-16, the modular thumb rest 108 is removably positioned within the vertical slot 132, 141 of either or both of the first sidewall 130 and the second sidewall 140. The modular thumb rest 108 is installed in the vertical slot 132, 141 by sliding the tongue 111 into the vertical groove 135 of the vertical slot 132 until the top edge 121 of the modular thumb rest 108 (or the top edge 121 of the mounting body 110) is substantially flush with the upper edge 131 of the first sidewall 130 (or the second sidewall 140, as the case may be). When removably positioned within the vertical slot 132, 141, the modular thumb rest 108 laterally extends away from the modular frame 103.

Moreover, FIGS. 10-16 illustrate an example of the tongue 111 of the modular thumb rest 108 being within the vertical groove 135 of the vertical slot 132 when the modular thumb rest 108 is removably positioned within the vertical slot 132. Additionally, as illustrated, portions of the mounting body 110 contact and are flush with each channel 136 of the inner surface 133 and the outer surface 134 of the first sidewall 130. Likewise, the tongue 111 contacts and is flush with the vertical groove 135 that is between the inner surface 133 and the outer surface 134 of the first sidewall 130.

Accordingly, a flush and aesthetically pleasing mounting of the modular thumb rest 108 is accomplished without the need for any bulky mounting plates or other mounting assemblies. Yet, the assembly provides a secure connection between the modular thumb rest 108 and the modular frame 103 that can withstand recoil forces. The mounting of the modular thumb rest 108 is also significantly simpler, when compared to previous designs, as the tongue 111 of the modular thumb rest 108 slips into the vertical groove 135 of the vertical slot 132, 141, with no tools, screws, or bolts needed to form the connection. Consequently, the handgun can be more easily and quickly adapted for use, an advantage in tactical and competition shooting scenarios.

EXAMPLES

Illustrative examples of the disclosed technologies are provided below. A particular configuration of the technologies may include one or more, and any combination of, the examples described below.

Example 1 includes a modular thumb rest for coupling to a firearm, the modular thumb rest comprising: a thumb-pad surface; a mounting body extending away from a rear surface of the modular thumb rest in a first direction, the rear surface being opposite the thumb-pad surface; and a tongue extending away from the mounting body in a second direction that is substantially perpendicular to the first direction.

Example 2 includes the modular thumb rest of Example 1, in which the thumb-pad surface curves from a thinnest portion at a rear edge of the modular thumb rest to a thickest portion at a front edge of the modular thumb rest that is opposite the rear edge of the modular thumb rest.

Example 3 includes the modular thumb rest of any of Examples 1-2, in which the mounting body further includes a first surface that is substantially parallel to the first direction, and a second surface that is substantially parallel to the first direction, in which the tongue extends away from the mounting body between the first surface and the second surface and substantially perpendicular to each of the first surface and the second surface.

Example 4 includes the modular thumb rest of Example 3, in which each of the mounting body and the tongue has a top edge and a bottom edge opposite the top edge, in which the bottom edge of the mounting body and the bottom edge of the tongue are each substantially U-shaped.

Example 5 includes the modular thumb rest of any of Examples 3-4, in which the tongue further comprises a notch in a side edge that is between the top edge of the tongue and the bottom edge of the tongue.

Example 6 includes a frame assembly for a firearm, the frame assembly comprising a modular frame comprising a longitudinal sidewall, the sidewall having an upper edge, the upper edge having a substantially vertical slot through the upper edge; and a modular thumb rest removably positioned within the vertical slot.

Example 7 includes the frame assembly of Example 6, the modular frame further comprising a picatinny rail at a first end of the modular frame, the vertical slot being separate from the picatinny rail and being farther from the first end of the modular frame than the picatinny rail is from the first end of the modular frame.

Example 8 includes the frame assembly of any of Examples 6-7, the modular thumb rest comprising: a thumb-pad surface; a mounting body extending away from a rear surface in a first direction, the rear surface being opposite the thumb-pad surface; and a tongue extending away from the mounting body in a second direction that is substantially perpendicular to the first direction.

Example 9 includes the frame assembly of Example 8, the sidewall having an inner surface and an outer surface, the vertical slot comprising a substantially vertical groove between the inner surface and the outer surface, the tongue of the modular thumb rest being within the vertical groove of the vertical slot when the modular thumb rest is removably positioned within the vertical slot.

Example 10 includes the frame assembly of any of Examples 8-9, in which the thumb-pad surface curves from a thinnest portion at a rear edge of the modular thumb rest to a thickest portion at a front edge of the modular thumb rest that is opposite the rear edge of the modular thumb rest.

Example 11 includes the frame assembly of any of Examples 8-10, in which the mounting body further includes a first surface that is substantially parallel to the first direction, and a second surface that is substantially parallel to the first direction, in which the tongue extends away from the mounting body between the first surface and the second surface and substantially perpendicular to each of the first surface and the second surface.

Example 12 includes the frame assembly of Example 11, in which each of the mounting body and the tongue has a top edge and a bottom edge opposite the top edge, in which the bottom edge of the mounting body and the bottom edge of the tongue are each substantially U-shaped.

Example 13 includes the frame assembly of any of Examples 11-12, in which the tongue further comprises a notch in a side edge that is between the top edge of the tongue and the bottom edge of the tongue.

Example 14 includes the frame assembly of any of Examples 6-13, in which the sidewall is a first sidewall, the modular frame further comprising a longitudinal second sidewall, the first sidewall and the second sidewall being substantially parallel, the second sidewall having a substantially vertical slot through an upper edge of the second sidewall, in which the vertical slot of the second sidewall is configured to accept another modular thumb rest.

Example 15 includes a frame assembly for a firearm, the frame assembly comprising: a modular frame comprising a longitudinal first sidewall and a longitudinal second sidewall, the first sidewall and the second sidewall being substantially parallel, the first sidewall including a slot through the first sidewall; a picatinny rail having a proximal end and an opposite, distal end, the distal end of the picatinny rail being at a distal end of the modular frame, the slot being longitudinally between the proximal end of the picatinny rail and a proximal end of the modular frame, the proximal end of the modular frame being opposite the distal end of the modular frame; and a modular thumb rest removably positioned within the slot.

Example 16 includes the frame assembly of Example 15, the modular thumb rest comprising: a thumb-pad surface; a mounting body extending away from a rear surface in a first direction, the rear surface being opposite the thumb-pad surface; and a tongue extending away from the mounting body in a second direction that is substantially perpendicular to the first direction.

Example 17 includes the frame assembly of Example 16, the first sidewall having an inner surface and an outer surface, the vertical slot comprising a substantially vertical groove between the inner surface and the outer surface, the tongue of the modular thumb rest being within the vertical groove of the vertical slot when the modular thumb rest is removably positioned within the vertical slot.

Example 18 includes the frame assembly of any of Examples 16-17, in which the thumb-pad surface curves from a thinnest portion at a rear edge of the modular thumb rest to a thickest portion at a front edge of the modular thumb rest that is opposite the rear edge of the modular thumb rest.

Example 19 includes the frame assembly of any of Examples 16-18, in which the mounting body further includes a first surface that is substantially parallel to the first direction, and a second surface that is substantially parallel to the first direction, in which the tongue extends away from the mounting body between the first surface and the second surface and substantially perpendicular to each of the first surface and the second surface.

Example 20 includes the frame assembly of Example 19, in which each of the mounting body and the tongue has a top edge and a bottom edge opposite the top edge, in which the bottom edge of the mounting body and the bottom edge of the tongue are each substantially U-shaped.

Example 21 includes the frame assembly of any of Examples 19-20, in which the tongue further comprises a notch in a side edge that is between the top edge of the tongue and the bottom edge of the tongue.

The contents of the present document have been presented for purposes of illustration and description, but such contents are not intended to be exhaustive or limited to the disclosure in the form disclosed. Many modifications and variations will be apparent to those of ordinary skill in the art without departing from the scope and spirit of the disclosure. The aspects of the disclosure in this document were chosen and described to explain the principles of the disclosure and the practical application, and to enable others of ordinary skill in the art to understand the disclosure with various modifications as are suited to the particular use contemplated.

Accordingly, it is to be understood that the disclosure in this specification includes all possible combinations of the particular features referred to in this specification. For example, where a particular feature is disclosed in the context of a particular example configuration, that feature can also be used, to the extent possible, in the context of other example configurations.

Additionally, the described versions of the disclosed subject matter have many advantages that were either described or would be apparent to a person of ordinary skill. Even so, all of these advantages or features are not required in all versions of the disclosed apparatus, systems, or methods.

Also, when reference is made in this application to a method having two or more defined steps or operations, the defined steps or operations can be carried out in any order or simultaneously, unless the context excludes those possibilities.

The terminology used in this specification is for the purpose of describing particular aspects only and is not intended to be limiting of the disclosure. As used herein, the singular forms "a," "an," and "the" are intended to include the plural forms as well, unless the context clearly indicates otherwise. It will be further understood that the terms "comprises" or "comprising," when used in this specification, specify the presence of stated features, integers, steps, operations, elements, or components, but do not preclude the presence or addition of one or more other features, integers, steps, operations, elements, components, or groups thereof. Hence, for example, an article "comprising" or "which comprises" components A, B, and C can contain only components A, B, and C, or it can contain components A, B, and C along with one or more other components.

It is understood that the present subject matter may be embodied in many different forms and should not be construed as being limited to the example configurations set forth in this specification. Rather, these example configurations are provided so that this subject matter will be thorough and complete and will convey the disclosure to those skilled in the art. Indeed, the subject matter is intended to cover alternatives, modifications, and equivalents of these example configurations, which are included within the scope and spirit of the subject matter set forth in this disclosure. Furthermore, in the detailed description of the present subject matter, specific details are set forth to provide a thorough understanding of the present subject matter. It will be clear to those of ordinary skill in the art, however, that the present subject matter may be practiced without such specific details.

We claim:

1. A modular thumb rest for coupling to a firearm, the modular thumb rest comprising:

a thumb-pad surface;

a mounting body extending away from a rear surface of the modular thumb rest in a first direction, the rear surface being opposite the thumb-pad surface; and a tongue extending away from the mounting body in a second direction that is substantially perpendicular to the first direction, in which the mounting body further includes a first surface that is substantially parallel to the first direction, and a second surface that is substantially parallel to the first direction, in which the tongue extends away from the mounting body between the first surface and the second surface and substantially perpendicular to each of the first surface and the second surface, in which each of the mounting body and the tongue has a top edge and a bottom edge opposite the top edge, in which the bottom edge of the mounting body and the bottom edge of the tongue are each substantially U-shaped.

2. The modular thumb rest of claim 1, in which the thumb-pad surface curves from a thinnest portion at a rear edge of the modular thumb rest to a thickest portion at a front edge of the modular thumb rest that is opposite the rear edge of the modular thumb rest.

3. The modular thumb rest of claim 1, in which the tongue further comprises a notch in a side edge that is between the top edge of the tongue and the bottom edge of the tongue.

4. A frame assembly for a firearm, the frame assembly comprising:

a modular frame comprising a longitudinal sidewall, the sidewall having an upper edge, the upper edge having a substantially vertical slot through the upper edge; and a modular thumb rest removably positioned within the vertical slot, the modular thumb rest comprising:

a thumb-pad surface, a mounting body extending away from a rear surface in a first direction, the rear surface being opposite the thumb-pad surface, and a tongue extending away from the mounting body in a second direction that is substantially perpendicular to the first direction, in which the mounting body further includes a first surface that is substantially parallel to the first direction, and a second surface that is substantially parallel to the first direction, in which the tongue extends away from the mounting body between the first surface and the second surface and substantially perpendicular to each of the first surface and the second surface, in which each of the mounting body and the tongue has a top edge and a bottom edge opposite the top edge, in which the bottom edge of the mounting body and the bottom edge of the tongue are each substantially U-shaped.

5. The frame assembly of claim 4, the modular frame further comprising a picatinny rail at a first end of the modular frame, the vertical slot being separate from the picatinny rail and being farther from the first end of the modular frame than the picatinny rail is from the first end of the modular frame.

6. The frame assembly of claim 4, the sidewall having an inner surface and an outer surface, the vertical slot comprising a substantially vertical groove between the inner surface and the outer surface, the tongue of the modular thumb rest being within the vertical groove of the vertical slot when the modular thumb rest is removably positioned within the vertical slot.

7. The frame assembly of claim 4, in which the thumb-pad surface curves from a thinnest portion at a rear edge of the modular thumb rest to a thickest portion at a front edge of the modular thumb rest that is opposite the rear edge of the modular thumb rest.

8. The frame assembly of claim 4, in which the tongue further comprises a notch in a side edge that is between the top edge of the tongue and the bottom edge of the tongue.

9. The frame assembly of claim 4, in which the sidewall is a first sidewall, the modular frame further comprising a longitudinal second sidewall, the first sidewall and the second sidewall being substantially parallel, the second sidewall having a substantially vertical slot through an upper edge of the second sidewall, in which the vertical slot of the second sidewall is configured to accept another modular thumb rest.

10. A frame assembly for a firearm, the frame assembly comprising:

a modular frame comprising a longitudinal first sidewall and a longitudinal second sidewall, the first sidewall and the second sidewall being substantially parallel, the first sidewall including a slot through the first sidewall;

a picatinny rail having a proximal end and an opposite, distal end, the distal end of the picatinny rail being at a distal end of the modular frame, the slot being longitudinally between the proximal end of the picatinny rail and a proximal end of the modular frame, the proximal end of the modular frame being opposite the distal end of the modular frame; and a modular thumb rest removably positioned within the slot, the modular thumb rest comprising:

a thumb-pad surface, a mounting body extending away from a rear surface in a first direction, the rear surface being opposite the thumb-pad surface, and a tongue extending away from the mounting body in a second direction that is substantially perpendicular to the first direction, in which the mounting body further includes a first surface that is substantially parallel to the first direction, and a second surface that is substantially parallel to the first direction, in which the tongue extends away from the mounting body between the first surface and the second surface and substantially perpendicular to each of the first surface and the second surface, in which each of the mounting body and the tongue has a top edge and a bottom edge opposite the top edge, in which the bottom edge of the mounting body and the bottom edge of the tongue are each substantially U-shaped.

11. The frame assembly of claim 10, the first sidewall having an inner surface and an outer surface, the vertical slot comprising a substantially vertical groove between the inner surface and the outer surface, the tongue of the modular thumb rest being within the vertical groove of the vertical slot when the modular thumb rest is removably positioned within the vertical slot.

12. The frame assembly of claim 10, in which the thumb-pad surface curves from a thinnest portion at a rear edge of the modular thumb rest to a thickest portion at a front edge of the modular thumb rest that is opposite the rear edge of the modular thumb rest.

* * * * *